United States Patent [19]

Palmer

[11] 4,360,197

[45] Nov. 23, 1982

[54] SPRING ASSEMBLY FOR A TUMBLING BOARD

[76] Inventor: Leonard H. Palmer, 1168 Westwood Trail, Addison, Ill. 60101

[21] Appl. No.: 164,587

[22] Filed: Jun. 30, 1980

[51] Int. Cl.[3] ..... A63B 5/18

[52] U.S. Cl. ..... 272/65; 267/60

[58] Field of Search ..... 272/3, 4, 65, 66, 70, 272/109, 114; 36/7.8; 5/420, 475; 267/70, 91, 100, 103, 179, 182, 166, 60, 61 R

[56] References Cited

U.S. PATENT DOCUMENTS

| | | | |
|---|---|---|---|
| 1,509,750 | 9/1924 | Campbell | 272/65 X |
| 2,408,617 | 10/1946 | Ferrar | 36/7.8 |
| 2,742,957 | 4/1956 | Young | 5/475 X |
| 2,852,258 | 9/1958 | Dunklee et al. | 272/66 |
| 2,996,295 | 8/1961 | Smith | 272/66 X |
| 3,169,757 | 2/1965 | Roder et al. | 267/60 |
| 3,427,019 | 2/1969 | Brown | 272/114 |

FOREIGN PATENT DOCUMENTS

| | | | |
|---|---|---|---|
| 834823 | 3/1952 | Fed. Rep. of Germany | 272/114 |

*Primary Examiner*—Richard C. Pinkham
*Assistant Examiner*—Arnold W. Kramer
*Attorney, Agent, or Firm*—Wegner, McCord, Wood & Dalton

[57] ABSTRACT

A spring assembly for supporting a tumbling board including a helical spring and a mounting cap formed of a one piece homogeneous resilient material receiving one end of the spring. The mounting cap has a flat base for abutment with the underside of a tumbling board and a generally cylindrical projection extending from one side of the base into the interior of the spring end. An annular lip extends from the base and is spaced radially outwardly of the projection to define therewith a groove for receipt of the spring end. The groove narrows as the base is approached such that insertion of the spring into the groove will cause the lip and/or the projection to deform so that the resilience of the material of which the cap is formed will wedgingly cause the cap to tightly grasp the spring end. An aperture is provided in the base for receipt of a fastener by which the cap may be secured to a tumbling board and a protective cover is received on the other end of the spring.

13 Claims, 4 Drawing Figures

SPRING ASSEMBLY FOR A TUMBLING BOARD

BACKGROUND OF THE INVENTION

This invention relates to spring assemblies for use with tumbling boards, and more particularly, to such a spring assembly which is easily installed and which does not easily, though inadvertantly, disassemble.

In the gymnastic sport of tumbling, athletes perform various maneuvers on mats or the like, many of which require the athlete to spring high into the air with the maneuver being performed in mid air. This, of course, amongst other things, requires that the athlete have considerable "spring" in his or her legs. Frequently, in practice sessions, in order to teach the basics of the maneuver to be performed in mid air, the spring in the athlete's legs is artificially enhanced through the use of tumbling boards which support the mat on which the athlete is performing. In the usual case, the tumbling board is formed of one or more large sheets of any suitable material which are interconnected by any suitable means if more than one is used. A plurality of spring assemblies are secured to the underside of each such board and support the board in slightly elevated fashion, frequently on the order of two inches, above the underlying floor or the like. Consequently, the athlete performing on such a tumbling board, while moving downwardly under the influence of gravity, upon impacting against the mat supported by the tumbling board will cause compression of the springs. After initial compression of the springs due to the inertia of the athlete, the springs attempt to elevate the tumbling board and move the athlete upwardly thereby providing the aforementioned artificial assist to the spring in the athlete's legs.

Heretofore, such spring assemblies have typically been in the form of helical springs of perhaps two inches in length and a one inch diameter. The springs are secured at designated locations to the underside of the tumbling board by washers placed between adjacent convolutions of the spring near one end thereof with the washers then receiving a threaded fastener or the like. Thus, the washers sandwich one end of the associated spring against the board and in turn are held in place by a fastener.

Because the washers must be properly positioned in the spring ends, and care must be taken when the fastener is applied through the washer to prevent the washer from moving from its proper position relative to the spring, fabrication of such boards is extremely time consuming, particularly when it is considered that a typical four foot by eight foot sheet forming one tumbling board will require between 50 and 100 such spring assemblies.

Moreover, during use, the forces applied to such spring assemblies are not strictly axially of the spring with the consequence that the spring end will tend to move relative to the tumbling board and the washer secured thereto, again resulting in the spring becoming disassembled from the tumbling board thereby requiring time consuming reinstallation.

SUMMARY OF THE INVENTION

It is the principal object of the invention to provide a new and improved spring assembly for use with tumbling boards. More specifically, it is an object of the invention to provide a spring assembly that is easily initially installed and/or reinstalled and one which does not easily, inadvertantly become disassembled through forces incurred during use. An exemplary embodiment of the invention achieves the foregoing objects in an assembly including a helical spring. A mounting cap is formed of resilient material and receives one end of the spring. The mounting cap has a flat base for abutment with the underside of a tumbling board and a generally cylindrical projection extending from one side of the base into the interior of the end of the spring. An annular lip is disposed on the base and spaced radially outwardly of the projection to extend from the base in the same direction as the projection to define with the projection a groove for receipt of the spring end. The groove narrows as the base is approached such that insertion of the spring therein to will cause the lip and/or the projection to deform so that the resilience of the material of which the cap is formed will cause the cap to grasp the spring and hold the same in place. An aperture is disposed in the base for receipt of a fastener by which the cap may be secured to a tumbling board. The assembly is created by a protective cover received on the other end of the spring.

In a preferred embodiment, the protective cover includes an enlarged aperture aligned with the aperture in the base to allow installation of a fastener through the protective cover and the apertures are substantially coaxial with the helical axis of the spring.

In one embodiment of the invention, there are provided collapsible connections of limited length interconnecting the cap and the cover to assure maintenance of the assembly in assembled relation while allowing compression of the spring by oppositely directed forces applied respectively to the cap and to the cover.

In the usual case, both the cap and cover will be formed of a plastic material.

Other objects and advantages will become apparent from the following specification taken in connection with the accompanying drawings.

DESCRIPTION OF THE PREFERRED EMBODIMENT

Figure 1:
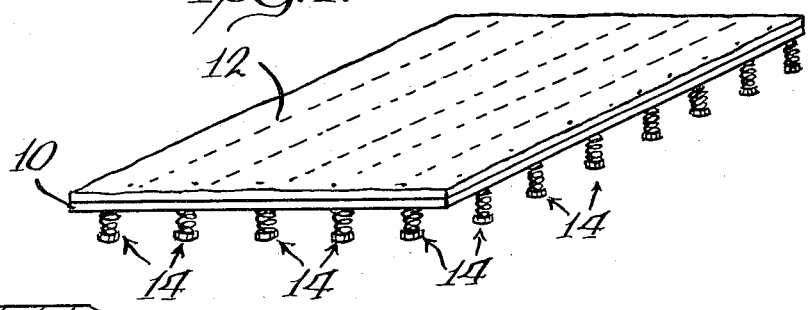
FIG. 1 is a perspective view of a tumbling board and mat utilizing spring assemblies made according to the invention.

Exemplary embodiments of spring assemblies made according to the invention are illustrated in the drawings to be employed with a tumbling board. As shown in FIG. 1, there is provided a tumbling board 10 which may be a 4×8 sheet of ½ inch plywood or the like. Superimposed on the tumbling board 10 is a gymnastic mat 12 while a plurality of spring assemblies, generally designated 14, are secured to the underside of the tumbling board 10 on, for example, 9¼ inch centers, there being 66 such assemblies 14 in all. The lower ends of the assemblies 14 support the tumbling board 10 in elevated relation above a floor or the like and conventionally will provide about a two inch spacing.

Figure 2:
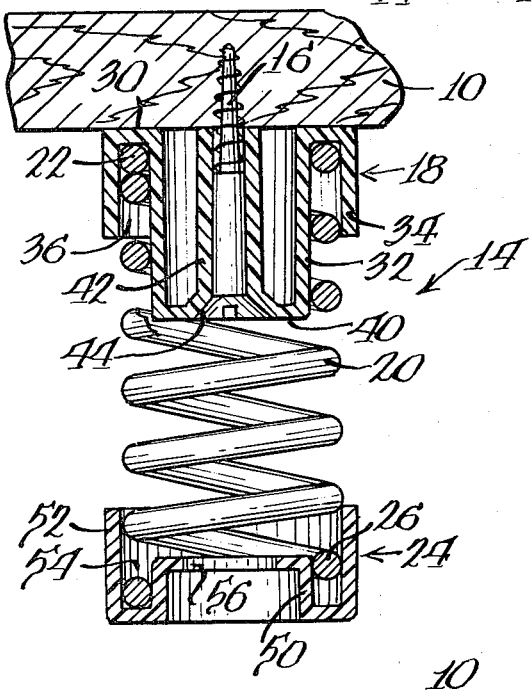
FIG. 2 is an enlarged, fragmentary sectional view of one form of spring assembly made according to the invention.

Turning now to FIG. 2, one form of a spring assembly made according to the invention is shown to be secured to the underside of the tumbling board 10 by a flathead screw 16. The spring assembly is made up of three basic components. The first is a cap, generally designated 18. The second is a helical spring 20 having an end 22 captured by the cap 18 as will be seen. The third component is a protective cover, generally designated 24, which receives the opposite end 26 of the spring 20. In general, the cap 18 serves to mount the entire assembly to the tumbling board 10 while the protective cover 24 serves principally to protect the underlying surface on which the tumbling board may be disposed from marring or the like by the spring end 26.

The cap 18 includes a generally flat base 30 for abutment with the underside of the tumbling board 10. Generally, the base 30 will have a circular periphery.

Inwardly of the periphery of the base 30, there is a generally cylindrical projection 32 which extends away from the base 30 coaxially with the helical axis of the spring 20 and into the end 22 thereof.

Radially outwardly of the projection 32 and extending from the base 30, there is an annular lip 34 which, with the projection 32, defines an annular groove 36 for receipt of the spring end 22.

Preferably, the cap 18 is formed of a plastic material, that is one having inherent resilience. The material must also be deformable.

The groove 36 is constructed such that it progressively narrows from its open end as the base 30 is approached. It is further constructed such that the spring end 22 cannot fully enter the same without deforming the plastic so that the inherent resilience of the plastic will cause the cap to tightly grasp the spring end 22. This can be accomplished in a variety of ways but a preferred method is to make the cylindrical projection 32 slightly frusto conical as, for example, having the sides thereof extend at a 1° angle to the helical axis of the spring and by causing the inner surface of the lip 34 to be formed at an identical, but opposite 1° angle such that the bottom of the groove 34 is narrower than the diameter of the wire of which the spring 20 is formed. Preferably, also, the outer diameter of the projection 32 adjacent the bottom of the groove 34 is slightly greater than the inner diameter of the spring 20 while the inner diameter of the lip 34 at the bottom of the groove 36 is slightly less than the outer diameter of the spring 20.

The projection 32 includes a flat end 40 opposite from the base 30 which in turn merges into an axially extending tube 42 which terminates in the plane of the base 30. The tube 42 defines an elongated hole or aperture for receipt of the screw 16 and preferably, the projection end 40 is provided with a countersunk formation 44. Thus, the screw 16 may be introduced through the tube 42 and threaded into the tumbling board 10.

Preferably, the projection 32 has a greater axial length than the lip 34. This axial length serves to pilot the spring end 22 into the groove 36 during assembly.

The protective cover 24 includes a central projection 50 which is received in the spring end 26 and a radially outwardly spaced, annular lip 52. The lip 52 surrounds the outer diameter of the spring end 26 and with the projection 50 defines an annular groove 54. The cover 24 is likewise formed with plastic and preferably, the projection 50 and lip 52 are configured with respect to each other and with respect to the spring end at angles and relations like those described in connection with the cap 18 so as to firmly grasp the spring end 26. The cover 24 is completed by an enlarged central aperture 56 of sufficient size that when the components are assembled together as illustrated in FIG. 2, the flathead screw 16 may be introduced through the aperture 56 and a screwdriver inserted therethrough to thread the screw 16 into the tumbling board 10.

In the embodiment illustrated in FIG. 2 and described above, installation can be accomplished in a variety of ways. If desired, the spring 20 and cover 26 may be removed from the cap 18 and the latter secured in place by means of the screw. Then, the spring end 22 may be forced into the groove 36 to complete the assembly. Alternately, and as alluded to above, if desired, the entire spring assembly can be installed without prior disassembly by introducing the screw 16 through the aperture 56 in the cover 24.

The assembly just described is easy to install and because the plastic cap 18 and cover 24 firmly grasps respective ends of the spring 20, will not inadvertantly disassemble during use. However, on occasion, if the tumbling board 10 with the spring assemblies in place is picked up and moved as for storage purposes, there is the possibility that forces directed against the spring 20 may cause the spring end 22 to slip from the groove 36. The disassociation is easily taken care of simply by placing the spring end 22 over the projection 30 and forcing the spring end 22 into the bottom of the groove 36. Where, however, disassembly of any sort is to be absolutely prevented, the embodiment of spring assembly illustrated in FIGS. 3 and 4 may be used.

Figure 3:
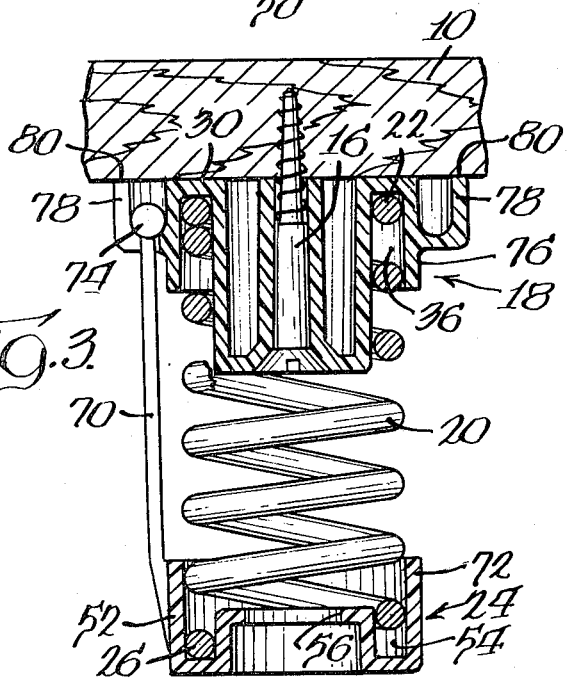
FIG. 3 is a view similar to FIG. 2 but of a modified embodiment of the spring assembly.
Figure 4:
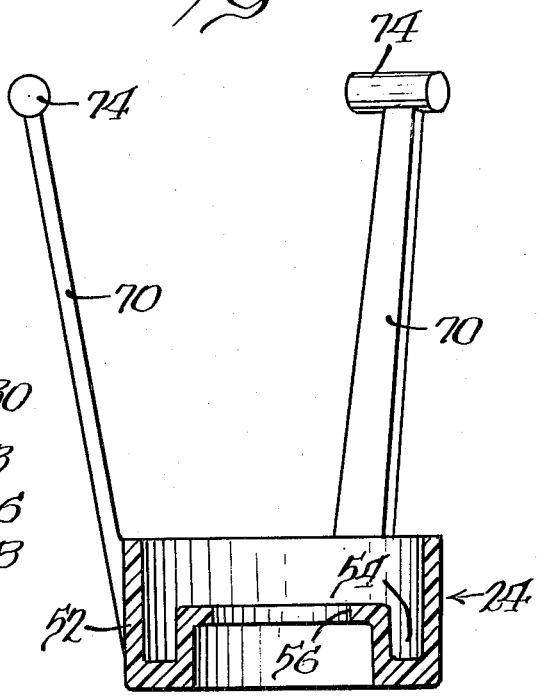
FIG. 4 is a sectional view of a portion of the spring assembly illustrated in FIG. 3.

The basic components of the embodiment illustrated in FIGS. 3 and 4 are identical to those described in connection with FIG. 2 and the interest of brevity, will not be described further. It is, however, to be noted that the embodiment of FIGS. 3 and 4 includes additional components which will now be described in detail.

Specifically, flexible and collapsible interconnections in the form of straps 70 interconnect the cap 18 and the protective cover 24. In the usual case, three such straps 70 will be employed and the same are formed of plastic, integrally with the protective cover 24 on the radially outer surface 72 of the lip 52. In an unstressed condition, the straps 70 assume the configuration illustrated in FIG. 4 and will be disposed about the lip 52 at 120° intervals. Each strap 70, at its end remote from the cover 24, terminates in a cylindrical cross member 74 to provide for an overall T-shape for each strap 70.

Because the straps 70 are formed of plastic, it will be appreciated that they can flex and collapse somewhat upon compression of the spring 20 during use of the tumbling board. However, their length is such as to not exceed the overall length of the assembly to thereby positively hold the components in assembled relation. To achieve this, the radially outer surface 76 of the lip 34 on the cap 18 is provided with aligned, integral hooks 78, usually six in number, which are paired. The spacing between the hooks 78 of each pair is slightly larger than the width of the strap 70 adjacent the cross member 74 while each pair of hooks is spaced at 120° intervals. It will be observed from FIG. 3 that the end 80 of each hook 78 terminates in the plane of the base 30 of the cap 18.

In the case of the embodiment illustrated in FIGS. 3 and 4, assembly is achieved as follows. The spring ends 22 and 26 are forced to the bottoms of the respective grooves 36 and 54 in which they are received. The spring 20 is then slightly compressed by oppositely directed forces applied to the cap 18 and the protective cover 24 until the cross members 74 of the straps 70 extend beyond the ends 80 of the hooks 78. At this time, the free ends of the straps 70 are deflected radially inwardly such that the ends 74 of the cross members overlie associated ones of the hooks 78. Compression of the spring 20 may then be released with the result that the assemblage will assume a configuration illustrated in FIG. 3. To install the spring assembly thus formed on a tumbling board 10, the screw 16 is then introduced through the aperture 56 in the protective cover 24 and threaded into the tumbling board 10. It will be observed that when such assembly is completed, the tumbling board 10 itself obstructs movement of the cross members 74 on the straps 70 out of the hooks 78 thereby absolutely preventing inadvertant disassembly of the spring construction.

From the foregoing, it will be appreciated that a spring assembly made according to the invention is easy to install and is not subject to inadvertant disassembly during normal use. In one form of the invention, inadvertant disassembly is absolutely precluded while in the other form, should inadvertant disassembly occur during non-usual use as, during storage of the tumbling board 10, reassembly is achieved simply by inserting the end 22 of the spring 20 into the groove 36.

I claim:

1. A spring assembly for supporting a tumbling board comprising:

a helical spring;

a one-piece mounting cap formed of a homogeneous resilient material receiving one end of said spring and having a flat base for abutment with the underside of a tumbling board, a generally cylindrical projection extending from one side of said base into the interior of said spring one end, an annular lip spaced radially outwardly of said projection and extending from said base one side to define, with said projection, a groove for receipt of said spring one end, said groove narrowing as said base is approached such that insertion of said spring one end thereinto will cause said spring one end to be wedged therein and further cause said lip and/or said projection to resiliently deform so that said cap firmly grasps said spring one end, and an aperture in said base for receipt of a fastener by which said cap may be secured to a tumbling board; and a protective cover received on the other end of said spring.

2. The spring assembly of claim 1 wherein said protective cover includes an enlarged aperture aligned with the aperture in said base to allow installation of a fastener through said protective cover, said aperture being substantially coaxial with the helical axis of said spring.

3. The spring assembly of claim 1 wherein said projection has a longer axial length than said lip which serves to pilot said spring one end into said groove during fabrication of said assembly.

4. The spring assembly of claim 1 further including collapsible connections of limited length interconnecting said cap and said cover to assure maintenance of said assembly in assembled relation while allowing compression of said spring by oppositely directed forces applied respectively to said cap and said cover.

5. The spring assembly of claim 1 wherein said cover includes a central projection disposed in said spring other end and an annular lip radially outwardly of said central projection and defining a groove therewith, said cover groove progressively narrowing as its bottom is approached.

6. The spring assembly of claim 1 wherein said aperture is centrally located in said projection and is defined by an elongated hole, the end of said hole remote from said base including a countersunk formation.

7. A spring assembly for supporting a tumbling board comprising:

a helical spring;

a mounting cap formed of resilient material receiving one end of said spring and having a flat base for abutment with the underside of a tumbling board, a generally cylindrical projection extending from one side of said base into the interior of said spring one end, an annular lip spaced radially outwardly of said projection and extending from said base one side to define, with said projection, a groove for receipt of said spring one end, said groove narrowing as said base is approached such that insertion of said spring thereinto will cause said lip and/or said projection to deform so that the resilience of said material will cause said cap to grasp said spring one end, and an aperture in said base for receipt of a fastener by which said cap may be secured to a tumbling board;

a protective cover received on the other end of said spring; and collapsible connections of limited length interconnecting said cap and said cover to assure maintenance of said assembly in assembled relation while allowing compression of said spring by oppositely directed forces applied respectively to said cap and said cover, said collapsible connections comprising plastic straps formed integrally as part of one of said cap and said cover, the other of said cap and said cover having hooks for releasable receipt of said straps.

8. The spring assembly of claim 7 wherein said straps are formed on said cover and said hooks are formed on said cap to open oppositely of said projection and generally in the plane of said base whereby when said straps are fastened to said hooks and said cap secured to a tumbling board, the tumbling board obstructs dissociation of said straps from said hooks.

9. A tumbling board comprising, in combination:

a board defining opposite faces; and a plurality of spring assemblies secured to one face of said board, each said spring assembly comprising a helical spring, a one-piece mounting cap formed of a homogenous resilient material receiving one end of said spring and having a flat base for abutment with the underside of a tumbling board, a generally cylindrical projection extending from one side of said base into the interior of said spring one end, an annular lip spaced radially outwardly of said projection and extending from said base one side to define, with said projection, a groove for receipt of said spring one end, said groove narrowing as said base is approached such that insertion of said spring thereinto will cause said lip and/or said projection to deform so that the resilience of said material will cause said cap to grasp said spring one end, and an aperture in said base for receipt of a fastener by which said cap may be secured to a tumbling board, a protective cover received on the other end of said spring, and collapsible connections of limited length interconnecting said cap and said cover to assure maintenance of said assembly in assembled relation while allowing compression of said spring by oppositely directed forces applied respectively to said cap and said cover, said cap and said cover being formed of plastic and said collapsible connections comprising plastic straps formed integrally as part of one of said cap and said cover, the other of said cap and said cover having hooks for releasable receipt of said straps.

10. A spring assembly for supporting a tumbling board comprising:

a helical spring;

a mounting cap receiving one end of said spring and having a flat base for abutment with the underside of a tumbling board, the side of said mounting cap remote from said base including an annular lip sized to receive said spring one end, and an aperture in said base for receipt of a fastener by which said cap may be secured to a tumbling board;

a protective cover received on the other end of said spring; and collapsible connections of limited length integrally interconnecting said cap and said cover to assure maintenance of said assembly in assembled relation while allowing compression of said spring by oppositely directed forces applied respectively to said cap and said cover, one of said cap and said cover being formed of plastic and said collapsible connections comprising plastic straps formed integrally as part of said one of said cap and said cover, the other of said cap and said cover having hooks for releasable receipt of said straps.

11. The spring assembly of claim 10 wherein said straps are formed on said cover and said hooks are formed on said cap to open generally toward the plane of said base, whereby when said straps are received by said hooks and said cap secured to a tumbling board, the tumbling board will obstruct disassociation of said straps from said hooks.

12. A spring assembly for supporting a tumbling board comprising:

a helical spring;

a mounting cap receiving one end of said spring and having a flat base for abutment with the underside of a tumbling board, the side of said mounting cap remote from said base including an annular lip sized to receive said spring one end, and an aperture in said base for receipt of a fastener by which said cap may be secured to a tumbling board;

a protective cover received on the other end of said spring; and collapsible connections of limited length interconnecting said cap and said cover to assure maintenance of said assembly in assembled relation while allowing compression of said spring by oppositely directed forces applied respectively to said cap and said cover, at least one of said cap and said cover being formed of plastic and said collapsible connections comprising plastic straps formed integrally as part of said one of said cap and said cover, and hook means for releasably interconnecting said straps and the other of said cap and said cover.

13. A tumbling board comprising, in combination:

a sheet board defining opposite faces; and a plurality of spring assemblies secured to one face of said board, each said spring assembly comprising a helical spring, a one-piece mounting cap formed of a homogeneous resilient material receiving one end of said spring and having a flat base for abutment with the underside of a tumbling board, a generally cylindrical projection extending from one side of said base into the interior of said spring one end, an annular lip spaced radially outwardly of said projection and extending from said base one side to define, with said projection, a groove for receipt of said spring one end, said groove narrowing as said base is approached such that insertion of said spring one end thereinto will cause said spring one end to be wedged therein and further cause said lip and/or said projection to resiliently deform so that said cap firmly grasps said spring one end, and an aperture in said base for receipt of a fastener by which said cap may be secured to a tumbling board, and a protective cover received on the other end of said spring.

* * * * *